United States Patent [19]

Goggia

[11] Patent Number: 5,072,345

[45] Date of Patent: Dec. 10, 1991

[54] POP-UP LANDSCAPE LIGHT

[76] Inventor: Steven J. Goggia, 625 Parra Grande, Santa Barbara, Calif. 93108

[21] Appl. No.: 606,105

[22] Filed: Oct. 31, 1990

Related U.S. Application Data

[62] Division of Ser. No. 481,190, Feb. 20, 1990, Pat. No. 4,984,139.

[51] Int. Cl.[5] ..... F21V 21/22

[52] U.S. Cl. ..... 362/153.1; 362/286; 362/364; 362/431

[58] Field of Search ..... 362/153.1, 364, 285, 362/286, 183, 418, 431; 343/903

[56] References Cited

U.S. PATENT DOCUMENTS

| | | | |
|---|---|---|---|
| 2,420,772 | 5/1947 | Dalton | 362/61 |
| 2,838,953 | 6/1958 | Cone | 343/903 |
| 4,180,850 | 12/1979 | Bivens | 362/285 |
| 4,181,268 | 1/1980 | Carolus et al. | 343/903 |
| 4,300,186 | 11/1981 | Hurd | 362/431 |
| 4,819,143 | 4/1989 | Teichmann | 362/418 |
| 4,841,416 | 6/1989 | Doss | 362/183 |
| 4,870,543 | 9/1989 | Born et al. | 362/418 |
| 4,974,134 | 11/1990 | Bourne | 362/286 |

*Primary Examiner*—Ira S. Lazarus
*Assistant Examiner*—Richard R. Cole
*Attorney, Agent, or Firm*—Jerry T. Kearns

[57] ABSTRACT

A pop-up landscape light has a cylindrical housing adapted for mounting below the surface of the ground in an outdoor environment. A light compartment is mounted for axial extension and retraction through an open top end of the housing to provide selective illumination. In a first embodiment of the present invention, a lead screw mechanism is utilized to extend and retract the light compartment from within the housing. In a second embodiment, a telescopic extensible member is connected to the light compartment and is actuated by winding or unwinding a coil of a flexible material driven by a motor through a bevel gear arrangement. In a third embodiment, a motorized swing arm mechanism is operative to rotate the light compartment through a predetermined angular increment, into and out of the housing, to provide selective illumination.

5 Claims, 11 Drawing Sheets

POP-UP LANDSCAPE LIGHT

BACKGROUND OF THE INVENTION

Cross Reference to Related Applications

This is a division of application Ser. No. 07/481,190, filed on Feb. 20, 1990, and now U.S. Pat. No. 4,984,139.

FIELD OF THE INVENTION

The present invention relates to landscape lights, and more particularly pertains to a landscape light adapted for use in outdoor environments to provide a decorative, selectively retractable ground level lighting fixture.

DESCRIPTION OF THE PRIOR ART

Various types of exterior lighting devices are known in the prior art. A typical example of such a lighting device is to be found in U.S. Pat. No. 4,429,355, which issued to J. Garchinsky on Jan. 31, 1984. This patent discloses a system for raising and lowering replacement bulbs in lenses to the top of tall street light poles. U.S. Pat. No. 4,441,145, which issued to R. Antkowiak on Apr. 3, 1984, discloses a growing light mounted for continuous movement in a cyclical manner along a horizontal track by a chain and sprocket motor driven mechanism. U.S. Pat. No. 4,462,067, which issued to C. Altman on July 24, 1984, discloses a spotlight adjusting system for controlling the beam of a spotlight. A reflector-lamp assembly is movable to a plurality of positions relative to the spotlight iris. The diaphragm of the iris is independently adjustable to a plurality of positions to vary the focal area of the spotlight beam. U.S. Pat. No. 4,519,021, which issued to J. Oram on May 21, 1985, discloses a surgical operating light including a plurality of lamp units mounted for adjustable movement on a loop track. U.S. Pat. No. 4,656,569, which issued to H. Buskell on Apr. 7, 1987, discloses an assembly for elevating a lamp canopy on a lamp standard which utilizes a screw mechanism to drive the canopy up and down the standard.

While the above mentioned devices are directed to various movable lighting fixtures, none of these devices disclose a pop-up landscape light having a lighting compartment axially extendable through an open top end of a below ground housing. Additionally, none of the aforementioned devices disclose the use of a lead screw mechanism in conjunction with a reversible stepping motor to extend and retract a light compartment from within a housing. An additional feature of the present invention, not contemplated by the aforesaid prior art devices, is the provision of a telescopic extensible member actuated by the winding and unwinding of a flexible member from a spiral coil which is driven by an electric motor to a bevel gear arrangement. Inasmuch as the art is relatively crowded with respect to these various types of lighting devices, it can be appreciated that there is a continuing need for and interest in improvements to such lighting devices, and in this respect, the present invention addresses this need and interest.

SUMMARY OF THE INVENTION

In view of the foregoing disadvantages inherent in the known types of landscape lights now present in the prior art, the present invention provides an improved pop-up landscape light. As such, the general purpose of the present invention, which will be described subsequently in greater detail, is to provide a new and improved pop-up landscape light which has all the advantages of the prior art landscape lights and none of the disadvantages.

To attain this, representative embodiments of the concepts of the present invention are illustrated in the drawings and make use of a pop-up landscape light which has a cylindrical housing adapted for mounting below the surface of the ground in an outdoor environment. A light compartment is mounted for axial extension and retraction through an open top end of the housing to provide selective illumination. In a first embodiment of the present invention, a lead screw mechanism is utilized to extend and retract the light compartment from within the housing. In a second embodiment, a telescopic extensible member is connected to the light compartment and is actuated by winding or unwinding a coil of a flexible material driven by a motor through a bevel gear arrangement. In a third embodiment, a motorized swing arm mechanism is operative to rotate the light compartment through a predetermined angular increment, into and out of the housing, to provide selective illumination.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pop-up landscape light which has all the advantages of the prior art landscape lights and none of the disadvantages.

It is another object of the present invention to provide a new and improved pop-up landscape light which may be easily and efficiently manufactured and marketed.

It is a further object of the present invention to provide a new and improved pop-up landscape light which is of a durable and reliable construction.

An even further object of the present invention is to provide a new and improved pop-up landscape light which is susceptible of a low cost of manufacture with regard to both materials and labor, and which accordingly is then susceptible of low prices of sale to the consuming public, thereby making such landscape lights economically available to the buying public.

Still yet another object of the present invention is to provide a new and improved pop-up landscape light which provides in the apparatuses and methods of the prior art some of the advantages thereof, while simultaneously overcoming some of the disadvantages normally associated therewith.

Still another object of the present invention is to provide a new and improved pop-up landscape light which is automatically extensible and retractable to provide illumination in an exterior environment.

Yet another object of the present invention is to provide a new and improved pop-up landscape light which utilizes a reversible electric stepping motor in conjunction with a lead screw to selectively extend and retract a lighting compartment from within a below ground housing.

Even still another object of the present invention is to provide a new and improved pop-up landscape light which utilizes a telescopic extensible member actuated by the winding and unwinding of an elongated flexible member from a spiral coil, driven through a bevel gear arrangement by an electrical motor.

Even still another embodiment of the invention is to provide a new and improved pop-up landscape light which utilizes a motorized swing arm mechanism to rotate a light compartment to a predetermined angle of illumination.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
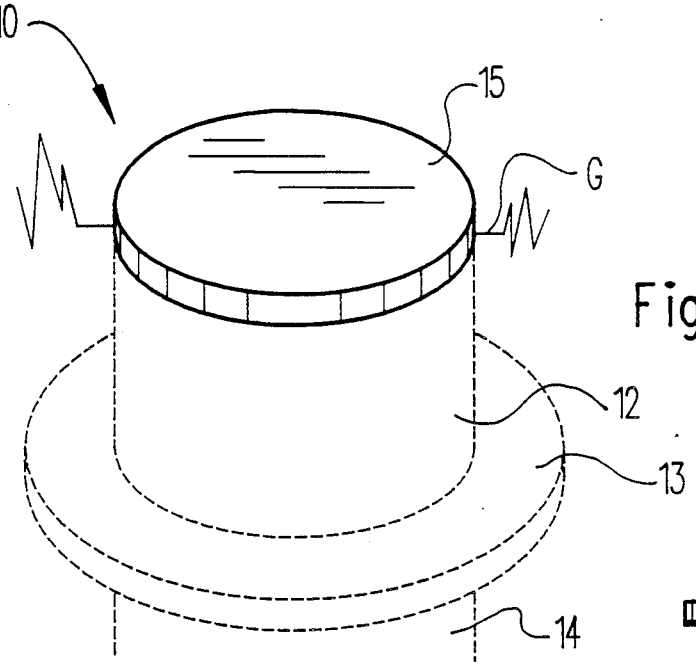
FIG. 1 is a diagrammatic perspective view of the pop-up landscape light according to a first embodiment of the present invention.

With reference now to the drawings, and in particular to FIG. 1 thereof, a new and improved pop-up landscape light embodying the principles and concepts of the present invention and generally designated by the reference numeral 10 will be described.

More specifically, it will be noted that the first embodiment 10 of the invention includes a generally cylindrical housing having an upper portion 12 separated from a lower portion 14 by an increased diameter radial flange 13. The housing portions 12, 13 and 14 are formed from a water-proof material and are adapted to be buried below the ground level G in an outdoor environment. An end cap 15 of an interior light compartment covers an open top end of the housing portion 12.

Figure 2:
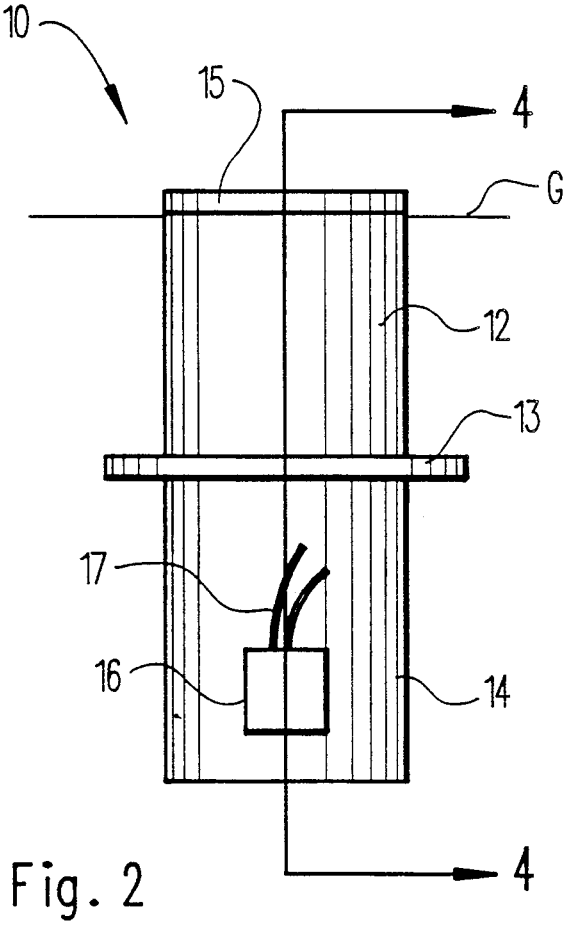
FIG. 2 is a side view of the pop-up landscape light of FIG. 1.

As shown in FIG. 2, a water-proof control housing 16 is formed on the housing portion 14 and is connected by suitable cables 17 to an electrical power source. The radial flange 13 is an optional feature, which affords a positioning and alignment surface for mounting the housing in a cylindrical hole formed in the ground G.

Figure 3:
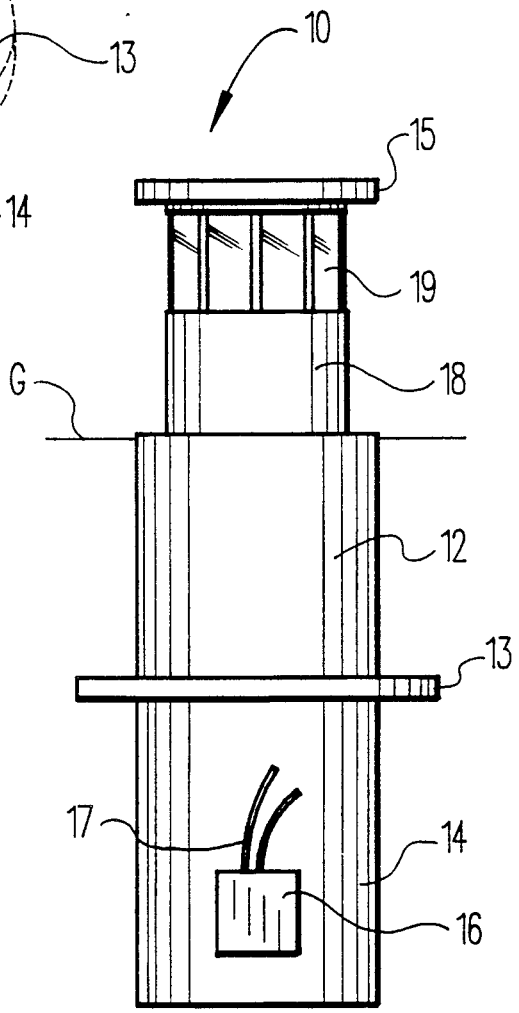
FIG. 3 is a side view of the pop-up landscape light of FIG. 2, in an extended position.

FIG. 3 illustrates the light compartment 18 extended above the ground level G, through the open top end of the housing portion 12. The light compartment 18 is thus mounted for reciprocal axial sliding extension and retraction within the stationary housing. The light compartment 18 includes a polygonal top portion 19 having a plurality of angularly intersecting facets formed from a transparent or translucent material. The end cap 15 is dimensioned to completely cover the open top end of the housing portion 12, when in a retracted position.

Figure 4:
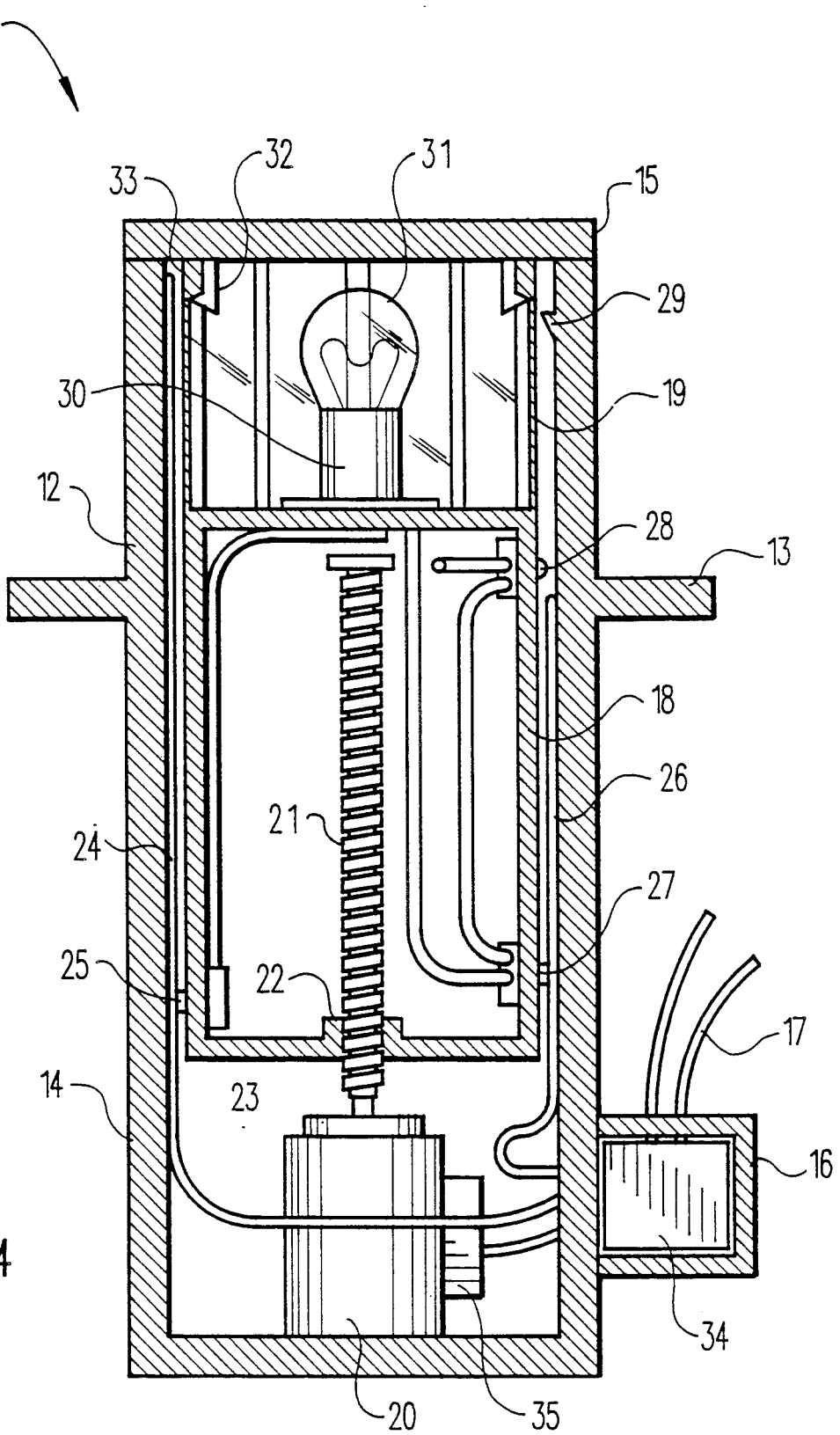
FIG. 4 is a longitudinal cross sectional view, taken along line 4—4 of FIG. 2.

As shown in FIG. 4, a rotary reversible electric stepping motor 20 is mounted within a bottom floor portion of the lower housing portion 14. The motor 20 has a rotary output shaft connected to an axially extending lead screw 21. The lead screw 21 extends centrally through a bottom floor portion 23 of the light compartment 18, and is in threaded engagement with a lead nut 22 formed therein. Thus, rotation of the lead screw 21 by the motor 20 causes the light compartment 18 to be moved axially along the length of the screw 21. A pair of electrical contacts 25 and 27 are secured on a lower side wall surface of the light compartment 18, and are in a sliding contacting relationship with elongated electrical contact strips 24 and 26 which extend along the length of the housing portions 12 and 14. Thus, an electrical current may be transmitted to a conventional electrical bulb socket 30, regardless of the axial position of the light compartment 18. A conventional electric light bulb 31 is disposed within the socket 30. A control or relay unit 34 is mounted within the exterior control housing 16 and is connected by cables 17 to a conventional power source. The cables 17 may supply a reduced voltage DC current from a remote transformer, or may alternatively, supply AC current to a transformer located within the control unit 34. In either case, the control unit 34 includes a solid state switching circuit adapted to provide simultaneous current to the stepping motor control 35, and to the electric lamp 31. The stepping motor control 35 may be of a conventional construction, and is adapted to provide a predetermined number of control pulses to the motor 20, to effect a precise number of revolutions of the lead screw 21. A limit switch 28 may be operatively connected with the stepping motor control 35 to deactivate the motor 20 upon contact with a radially inwardly extending projection 29 formed within the housing portion 12. Thus, the light compartment 18 will extend axially upwardly, until contact of the limit switch 28 with the actuating projection 29. The relative axial positions of the limit switch 28 and the projection 29 may be suitably selected, in accordance with the length of the lead screw 21, to vary the full extended height of the light compartment 18. A removable cap 15 is secured by a plurality of resilient catch members 32 which engage a stepped ledge 33 formed on the light transmitting facets 19. This construction allows the end cap 15 to be removed when replacement of the bulb 31 is required. The power cables 17 may be connected to an external photo cell control unit, in a conventional manner, such that the landscape light 10 is automatically actuated to extend and retract according to ambient light levels. Alternatively, a manual switch may be employed.

Figure 5:
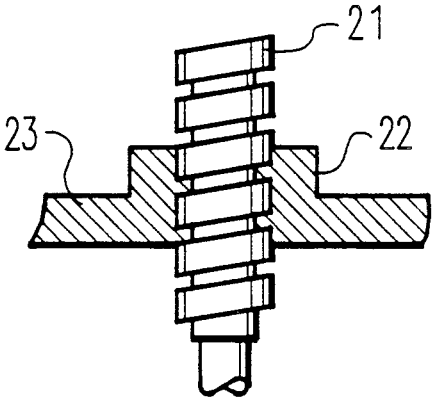
FIG. 5 is a partial cross sectional detail view, illustrating the lead screw mechanism for actuating the landscape light according to the first embodiment of the present invention.

FIG. 5 illustrates the lead screw 21 in threaded engagement with the lead nut 22 formed centrally in the bottom floor 23 of the light compartment.

Figure 6:
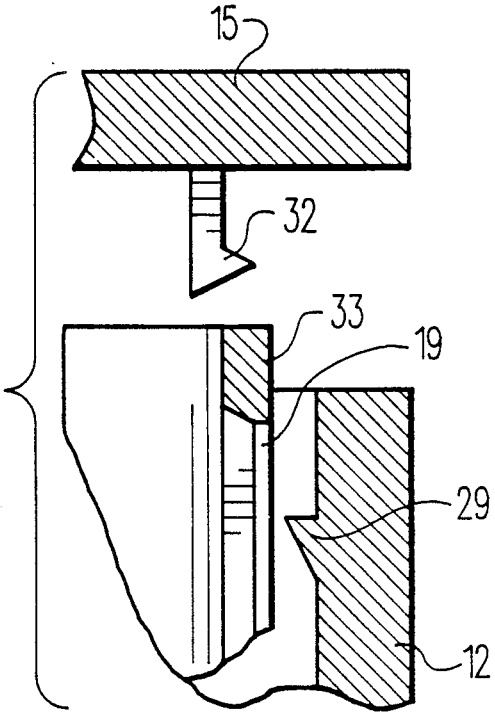
FIG. 6 is an exploded partial cross sectional detail view illustrating the removable end cap of the light compartment of the landscape light according to the first embodiment of the invention.

FIG. 6 illustrates the resilient catch member 32 utilized to secure the end cap 15 to the stepped ledge 33 provided on the light transmitting facet 19.

Figure 7:
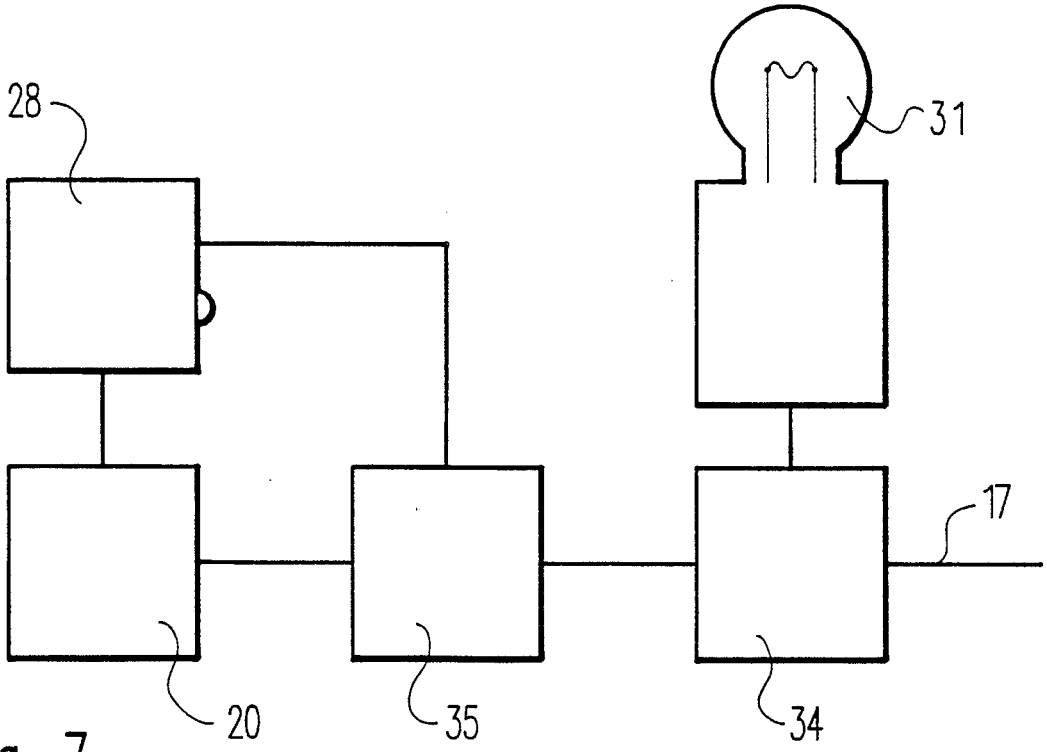
FIG. 7 is a block diagram illustrating the electrical components of the landscape light according to the first embodiment of the present invention.

FIG. 7 illustrates the electrical block diagram of the landscape light 10, according to the first embodiment of the invention. The external power is supplied by cables 17 to the relay control unit 34. The relay control unit 34 is operative to provide electrical current to the lamp 31, and simultaneously to the stepping motor control unit 35. The limit switch 28 may be employed to provide a feedback control to the stepping motor control 35, in order to deactivate the stepping motor 20, upon full extension of the light compartment from the below ground housing. As previously described, the numerical control unit 35 is preferably of a solid state construction, well known to those of ordinary skill in the art, which is operative to provide a predetermined number of control pulses to the stepping motor 20.

Figure 8:
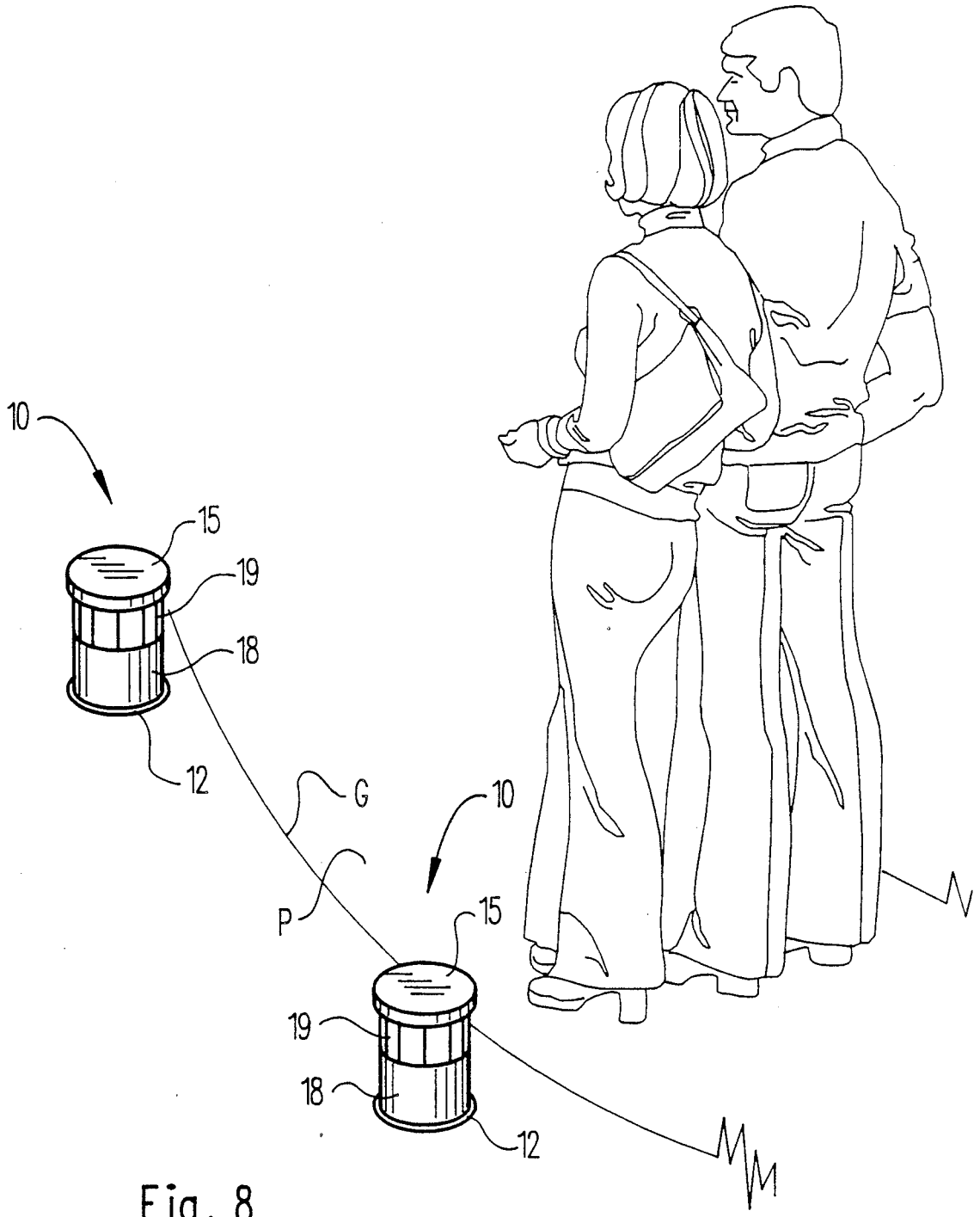
FIG. 8 is a perspective view illustrating the manner of use of the landscape lights according to the first embodiment of the present invention.

FIG. 8 is a perspective view which illustrates an example use of the landscape lights 10 according to the first embodiment of the invention. The housing 12 of the lights 10 is buried below the ground level G. The light compartments 18 of the lights 10 are illustrated in an extended position. Light is thus transmitted through the facets 19 to illuminate a sidewalk or garden path P. The pop-up feature of the landscape lights enables the surrounding lawn to be mowed by a conventional mower, with the light compartments 18 in a fully retracted position.

Figure 9:
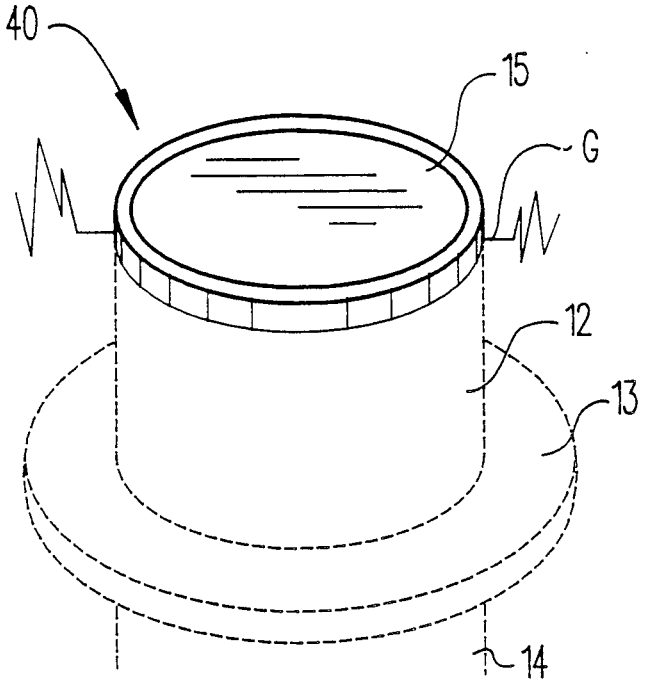
FIG. 9 is a diagrammatic perspective view illustrating a pop-up landscape light according to a second embodiment of the present invention.

FIG. 9 illustrates a landscape light 40 according to a second embodiment of the invention, in which similar parts have been designated by the reference numerals previously employed.

Figure 10:
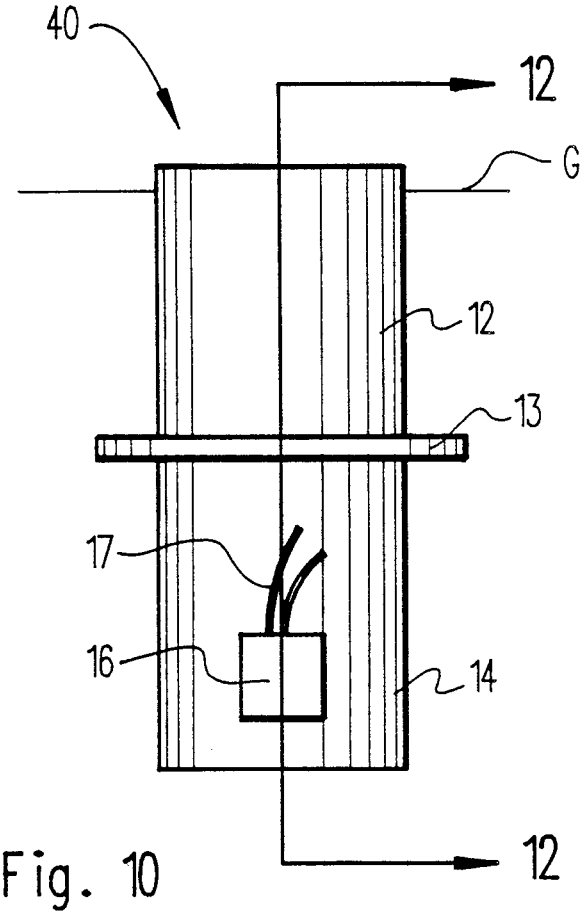
FIG. 10 is a side view of the landscape light of FIG. 9.

FIG. 10 illustrates the landscape light 40 in a retracted position, buried below the surface of the ground G, in a manner analogous to that described with respect to the first embodiment 10 of the invention.

Figure 11:
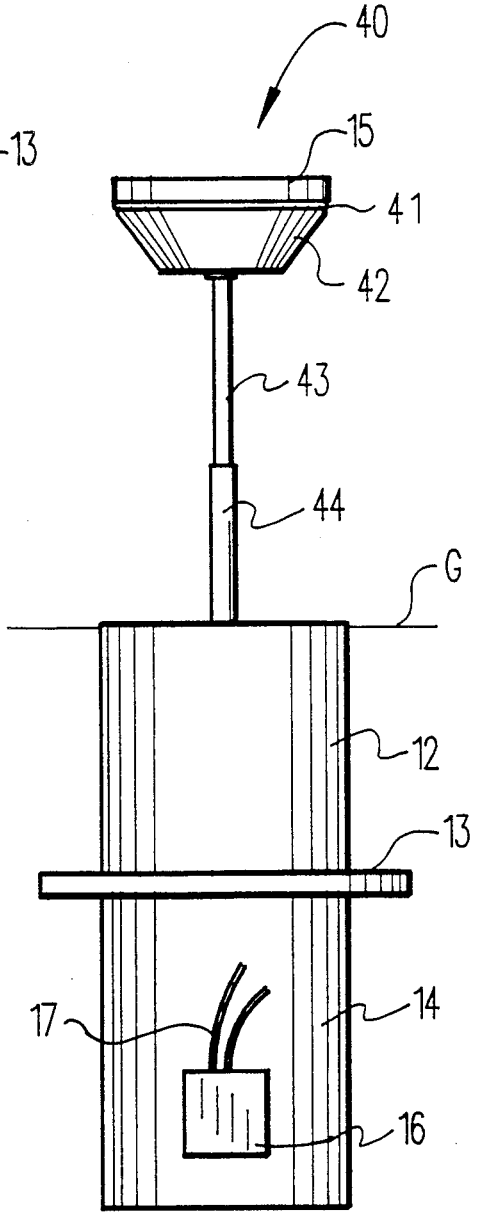
FIG. 11 is a side view of the landscape light of FIG. 10, in an extended position.

FIG. 11 illustrates the landscape light 40 in an extended position. The light compartment 42 is of a frusto conical shape and includes a surrounding resilient O-ring sealing member 41. The end cap 15 of the light compartment 42 is adapted to close a circular opening provided in a top end of the housing 12. The light compartment 42 is secured to a hollow cylindrical tubular member 43, which is received in telescopic engagement within an intermediate hollow cylindrical tubular member 44.

Figure 12:
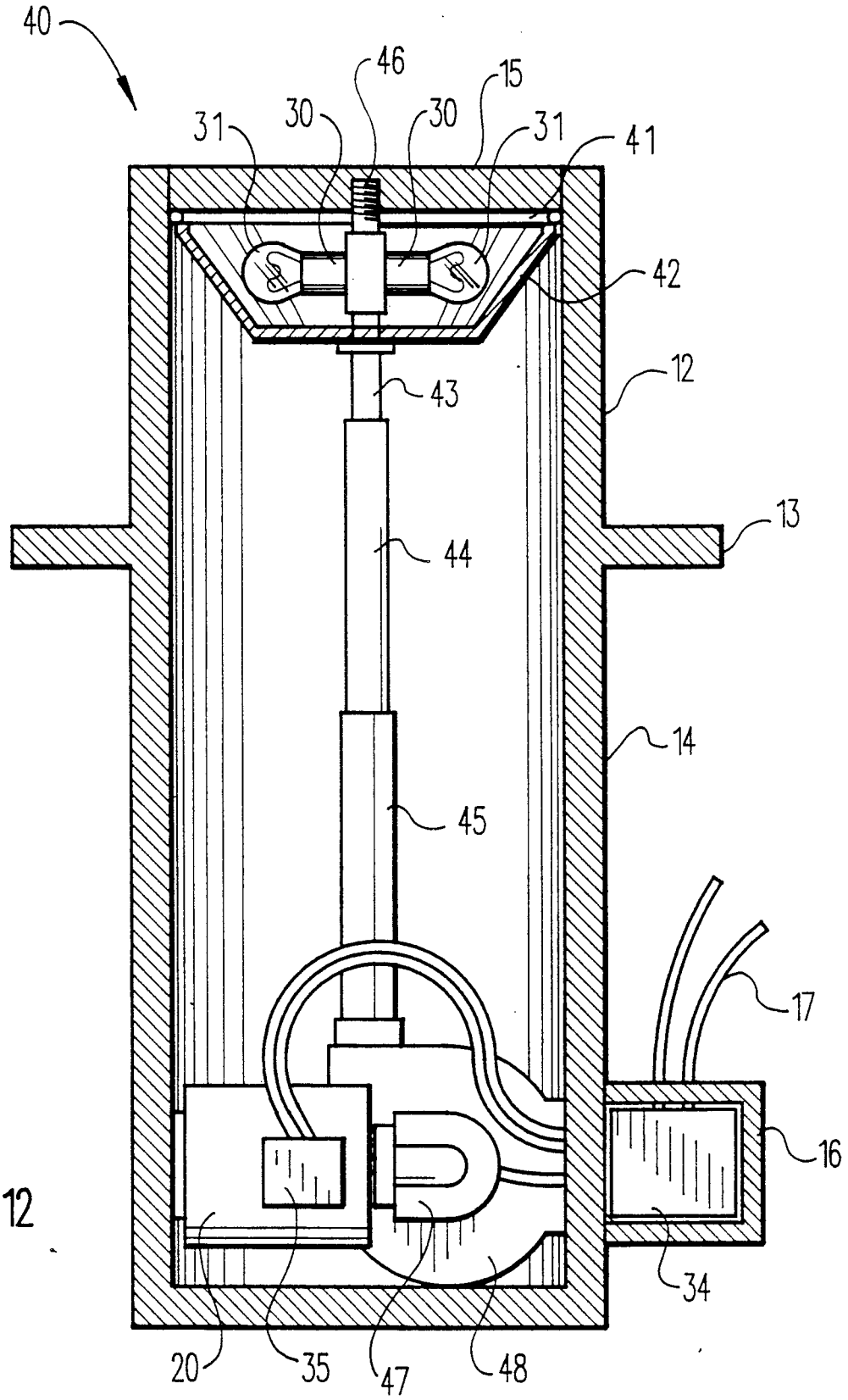
FIG. 12 is a longitudinal cross sectional view, taken along line 12—12 of FIG. 10.

As shown in the cross sectional view of FIG. 12, the intermediate tubular member 44 is telescopically engaged within a stationary tubular member 45. Thus, the light compartment 42 is mounted for extension and retraction from within the housing portion 12 by a telescopic extensible member formed by the tubular elements 43, 44 and 45. The end cap 15 may be secured by a threaded connection 46 to an upper end of the tubular member 43. Electrical wiring for providing current to the electric lamps 31 engage with the sockets 30 may be provided through the hollow tubular elements 43, 44 and 45. The telescopic extensible member is actuated by a rotary stepping motor 25 having a solid state numerical pulse controller 35. A coil housing 48 encloses a spiral coil of an elongated flexible material, which is driven through a bevel gear arrangement within the gear housing 47, by the motor 20. The frusto conical light compartment 42 is preferably formed from a transparent or translucent material. The O-ring sealing member 41 is preferably engageable within a complementary formed circumferential groove formed within the top interior portion of the housing 12.

Figure 13:
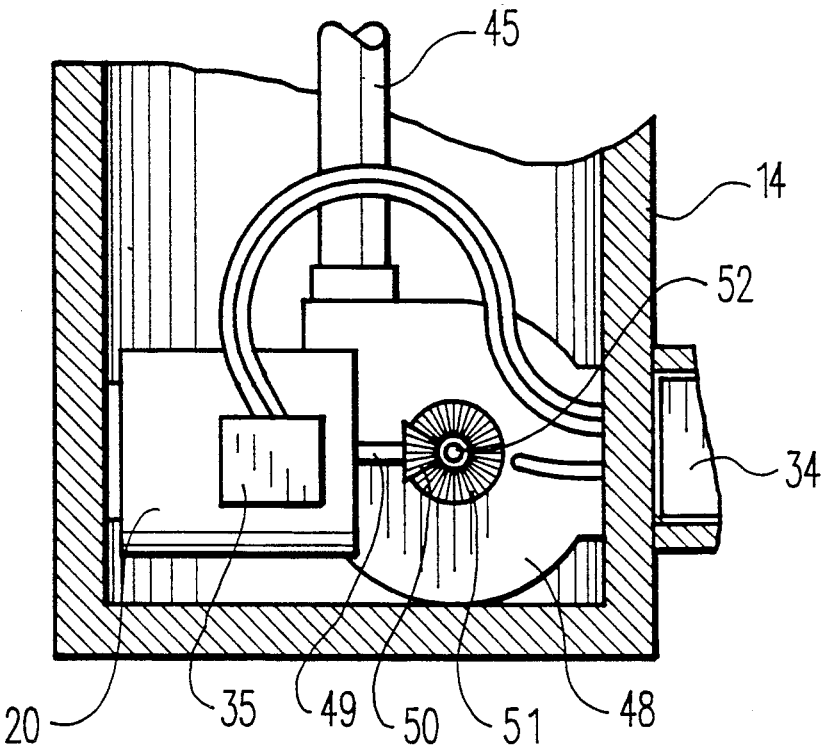
FIG. 13 is a partial cross sectional detail view, illustrating the telescopic extension and retraction mechanism.

As shown in the detail view of FIG. 13, a first bevel gear 50 is secured for rotation with the rotary output shaft 49 of the stepping motor 20. A second bevel gear 51 is secured to a shaft 52 which extends through the coil housing 48.

Figure 14:
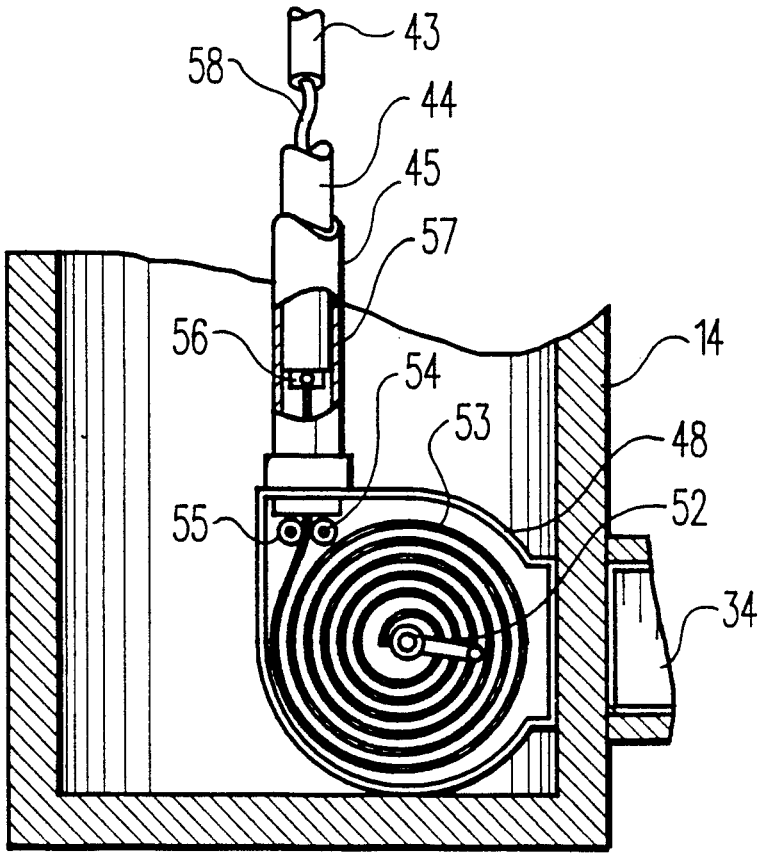
FIG. 14 is a further cross sectional detail view, illustrating the additional constructional details of the telescopic extension and retraction mechanism utilized in the landscape light according to the second embodiment of the invention.

As shown in FIG. 14, the rotary shaft 52, driven through the bevel gearing arrangement illustrated in FIG. 13, is secured to the inner end of a spiral coil 53, formed by an elongated flexible material, for example an intermediate gage wire, or a spring steel tape, for example of the type utilized in measuring tapes. The flexible member 53 extends between guide rollers 54 and 55 and through the interior of the tubular elements 45 and 44 and also through the upper tubular element 43. The upper end 58 of the flexible coil 53 is secured to an interior top end portion of the uppermost tubular member 43. The tubular sections 43 and 44 are provided with an interlocking interior flange construction (not shown), in the manner of a conventional telescopic antenna. Similarly, the intermediate tubular member 44 has a radial flange as indicated at 56 and 57 to prevent the tubular member 44 from being extended entirely through the top end of the stationary tubular member 45. This interlocking flange construction may be provided in a variety of conventional fashions, as is apparent to those familiar in the construction of telescopic antennas of the type utilized in portable radio units. Thus, the flexible member 53 has a sufficiently rigid nature to cause the upper tubular member 43 to be pushed axially upwardly, and subsequently extending the intermediate tubular member 44 from within the stationary tubular member 45. In a similar manner, when the coil 53 is wound in a reverse direction, the upper member 43 is pulled downwardly, and subsequently retracts the intermediate member 44 into the stationary lower member 45.

Figure 15:
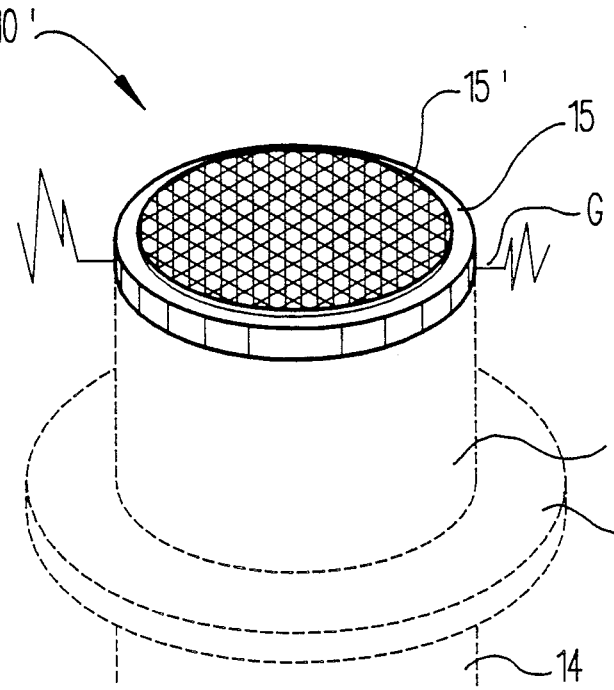
FIG. 15 is a partial perspective view illustrating a solar powered version of the landscape light illustrated in FIGS. 1–4.

FIG. 15 illustrates a landscape light 10' which is a solar powered version of the landscape light 10 illustrated in FIGS. 1–4 above. The landscape light 10' is substantially similar to the landscape light 10, and the same reference numerals have been utilized to designate similar parts. An array of solar cells 15' are provided on an upper exterior surface of the end cap 15.

Figure 16:
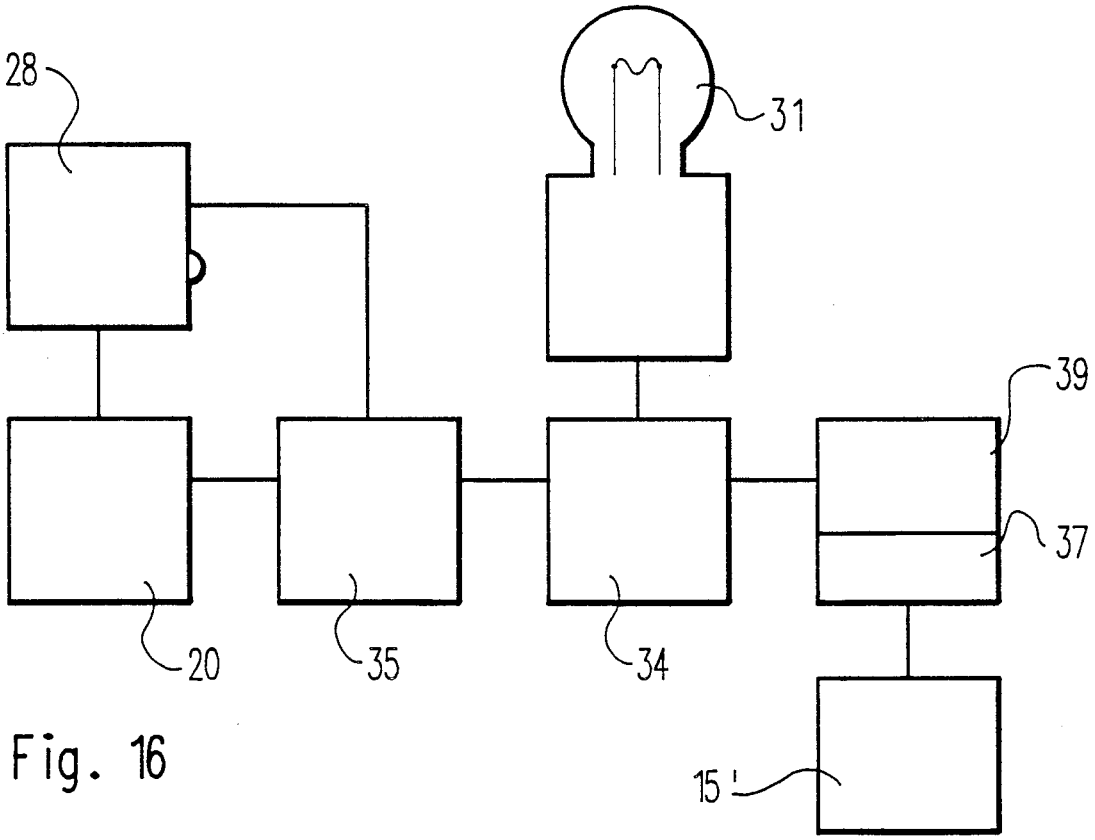
FIG. 16 is a block diagram illustrating the electrical components of the landscape light of FIG. 15.

As shown in the block diagram of FIG. 16, power is supplied from the solar cells 15' to the battery pack 39 via a recharging unit 37. The battery pack 39 is operatively connected to the relay control unit 34, to obviate the necessity for an external power source. The remaining components of the circuit are as described above with reference to FIG. 7.

Figure 17:
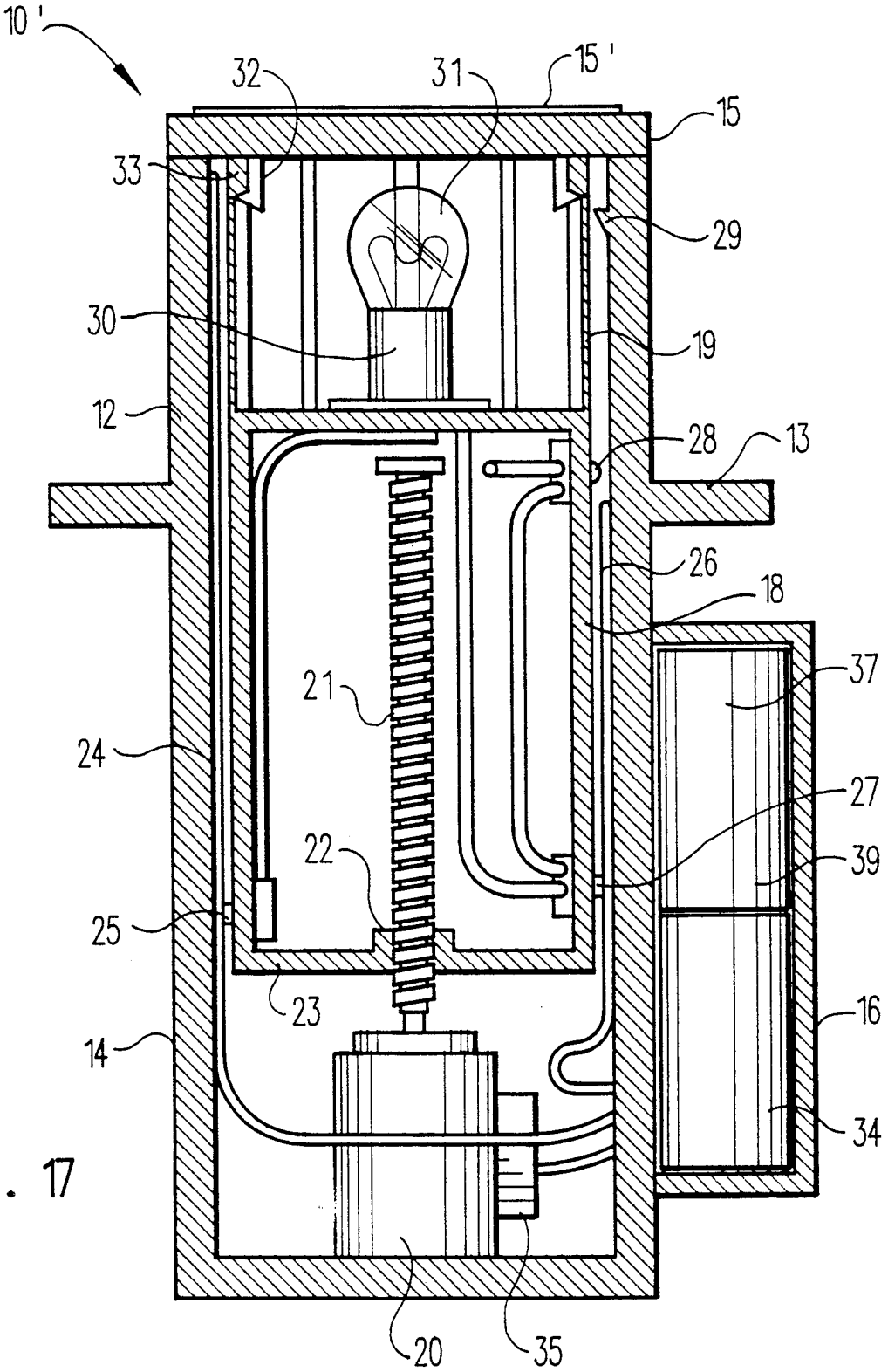
FIG. 17 is a longitudinal cross sectional view illustrating the landscape light of FIG. 15.

FIG. 17 illustrates a cross sectional view, similar to FIG. 4 above, which illustrates the solar cells 15', battery pack 39, and recharging unit 37.

Figure 18:
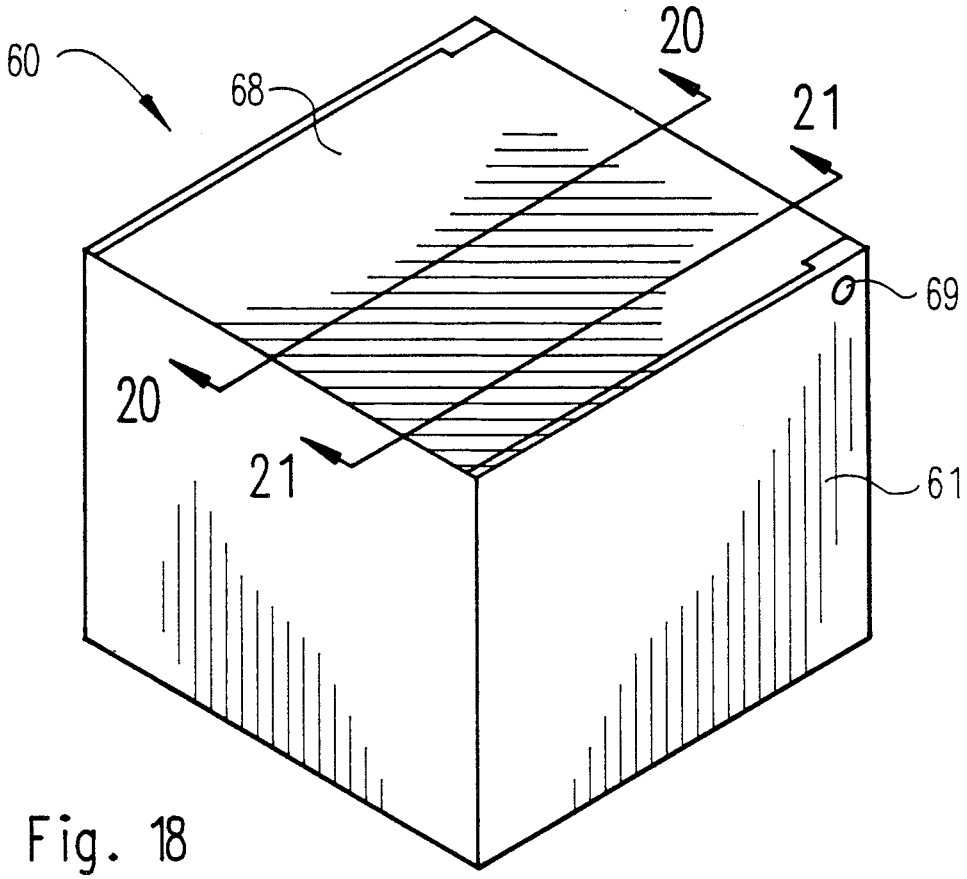
FIG. 18 is a perspective view illustrating a landscape light according to a third embodiment of the invention, in a closed position.

FIG. 18 illustrates a landscape light 60 according to a third embodiment of the invention, in which a hollow, generally cubical housing 61 has a pivotal cover 68, mounted by a pivot pin 69. The cover 68 is shown in the closed position.

Figure 19:
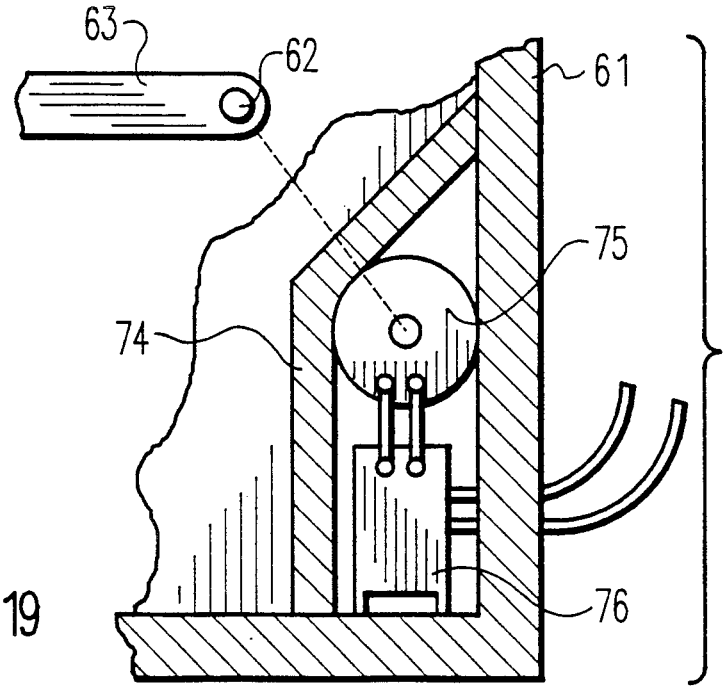
FIG. 19 is a partial cross sectional detail view illustrating a motorized linkage for extending and retracting a pivotal light mechanism of the landscape light of FIG. 18.

As shown in FIG. 19, a motor 75 is disposed within a motor enclosure portion 74 within the housing 61. The motor 75 is connected to a control unit 76, which may be powered by an external power source, or by a solar cell arrangement as previously described. The motor 75 is preferably a stepping motor having a drive shaft connected to an arm 63 at a connection 62. The motor 75 is operative to rotate the arm 63 through limited angular increments in either direction. Alternatively, the motor 75 may be a reversible motor controlled by limit switches.

Figure 20:
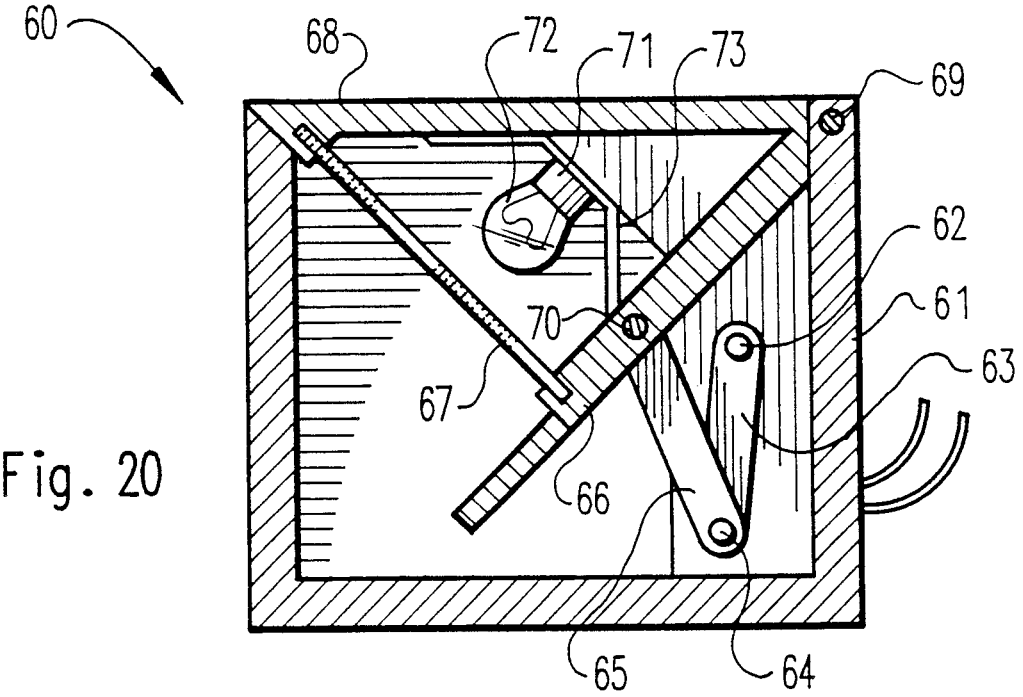
FIG. 20 is a transverse cross sectional view taken along line 20—20 of FIG. 18, illustrating the landscape light in a closed position.

As shown in FIG. 20, the cover 68 has an interior leg portion 66 integral therewith, forming a V configuration. The arm 63 is connected to a second arm 65 by a pivot pin 64. The opposite end of the arm 65 is connected by a pivot pin 70 to the leg portion 66. A lens 67 covers a light receptacle formed in the space between the cover 68 and the leg portion 66. A bulb 72 is mounted in a socket 71 surrounded by a reflector 73.

Figure 21:
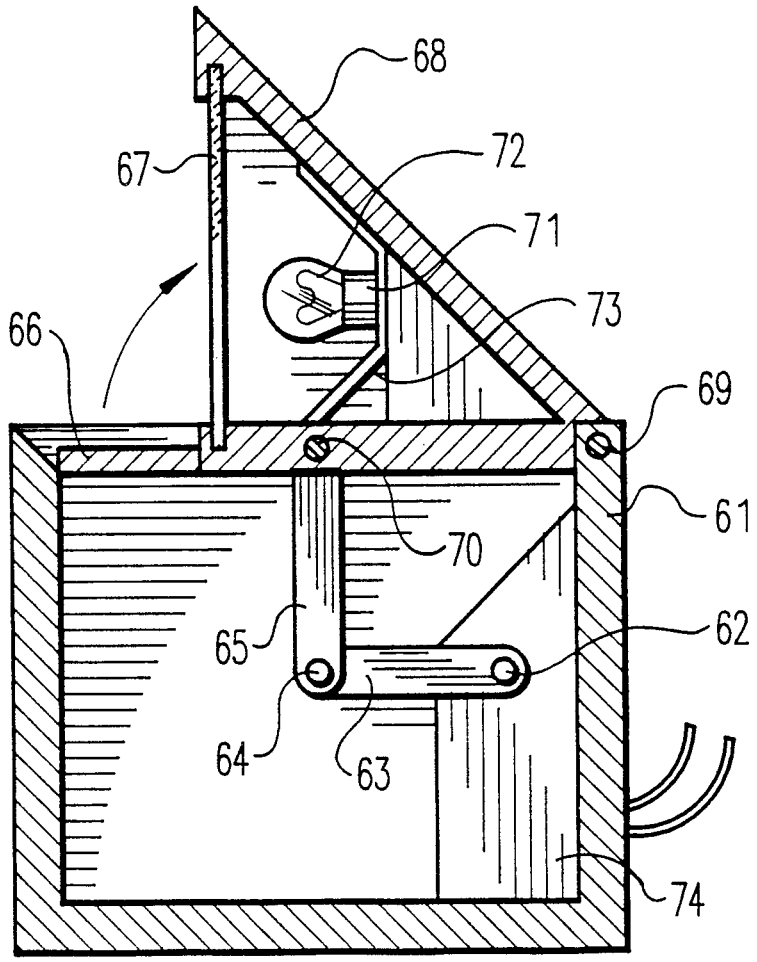
FIG. 21 is a transverse view taken along line 21—21 of FIG. 18, illustrating the landscape light in an open position.

FIG. 21 illustrates the cover 68 in an open position, which exposes the lens 67. Suitable control circuitry is operative to energize the light bulb 72 when the full open position of the cover 68 is reached. This may take the form of a limit switch arranged to contact one of the arms 63, 65, or the leg 66. Alternatively, a programmed control may be provided to provide power to the bulb 72 upon deactuation of the motor. The housing 61 may be mounted in an exposed position above ground, or mounted below ground such that only the cover 68 is exposed.

As may now be understood, the present invention provides an automatic extensible and retractable landscape light which may be mounted within a below ground housing utilizing ordinary AC current, 12 volt DC supplied through a transformer, or a solar cell recharged battery, to provide a utilitarian and ornamental lighting fixture which allows a surrounding lawn to be mowed by a conventional mower.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pop-up landscape light, comprising:

a housing;

a light compartment in said housing having a frusto conical shape;

an electric light in said light compartment;

a reversible electric rotary stepping motor in said housing;

control means for selectively actuating said stepping motor for a predetermined number of revolutions in opposite rotational directions;

a telescopically extensible member secured to said light compartment;

an elongated coil of flexible material having a free end extending through said telescopic extensible member;

electrical wiring extending through said telescopic extensible member and operably connected for supplying electrical power to said electric light; and meshing bevel gears connecting said motor to selectively wind and unwind said coil to extend and retract said telescopic extensible member for extending and retracting said light compartment through said circular opening in said top end of said housing.

2. The pop-up landscape light of claim 1, wherein said light compartment has a largest diameter upper end extensible through a circular opening in a top end of said housing.

3. The pop-up landscape light of claim 1, further comprising an O-ring surrounding said upper end of said light compartment for sealing engagement with said housing.

4. The pop-up landscape light of claim 1, further comprising solar power means for energizing said light and said motor.

5. The pop-up landscape light of claim 1, wherein said housing is formed from a water-proof material and is adapted to be partially buried in the ground.

* * * * *